US009111673B2

(12) United States Patent
Fullerton et al.

(10) Patent No.: US 9,111,673 B2
(45) Date of Patent: Aug. 18, 2015

(54) SYSTEM AND METHOD FOR MOVING AN OBJECT

(71) Applicant: Correlated Magnetics Research, LLC, Huntsville, AL (US)

(72) Inventors: Larry W. Fullerton, New Hope, AL (US); Mark D. Roberts, Huntsville, AL (US)

(73) Assignee: Correlated Magnetics Research, LLC., Huntsville, AL (US)

( * ) Notice: Subject to any disclaimer, the term of this patent is extended or adjusted under 35 U.S.C. 154(b) by 0 days.

(21) Appl. No.: 14/258,776

(22) Filed: Apr. 22, 2014

(65) Prior Publication Data

US 2014/0224620 A1 Aug. 14, 2014

Related U.S. Application Data

(63) Continuation of application No. 13/104,393, filed on May 10, 2011, now Pat. No. 8,704,626.

(60) Provisional application No. 61/395,205, filed on May 10, 2010.

(51) Int. Cl.
*H01F 7/02* (2006.01)

(52) U.S. Cl.
CPC ..... *H01F 7/0247* (2013.01)

(58) Field of Classification Search
CPC ..... H01F 7/0247; H01F 2003/103
USPC ..... 335/306, 302, 296, 219, 285, 295; 29/729, 744, 832
See application file for complete search history.

(56) References Cited

U.S. PATENT DOCUMENTS 93,931 A 8/1869 Westcott
361,248 A 4/1887 Winton
(Continued)

FOREIGN PATENT DOCUMENTS

CN 1615573 A 5/2005
DE 2938782 A1 4/1981
(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.
(Continued)

*Primary Examiner* — Mohamad Musleh
(74) *Attorney, Agent, or Firm* — Robert S. Babayi; Vector IP Law Group

(57) ABSTRACT

An improved system and method for moving an object includes a first correlated magnetic structure associated with a first object and a second correlated magnetic structure associated with a second object. The first and second correlated magnetic structures are complementary coded to achieve a peak attractive tensile force and a peak shear force when their code modulos are aligned thereby enabling magnetic attachment of the two objects whereby movement of one object causes movement of the other object as if the two objects were one object. Applying an amount of torque to one correlated magnetic structures greater than a torque threshold causes misalignment and decorrelation of the code modulos enabling detachment of the two objects. The number, location, and coding of the correlated magnetic structures can be selected to achieve specific torque characteristics, tensile force characteristics, and shear force characteristics.

20 Claims, 14 Drawing Sheets

(56) References Cited

U.S. PATENT DOCUMENTS

| | | | |
|---|---|---|---|
| 381,968 | A | 5/1888 | Tesla |
| 493,858 | A | 3/1893 | Edison |
| 675,323 | A | 5/1901 | Clark |
| 687,292 | A | 11/1901 | Armstrong |
| 996,933 | A | 7/1911 | Lindquist |
| 1,081,462 | A | 12/1913 | Patton |
| 1,171,351 | A | 2/1916 | Neuland |
| 1,236,234 | A | 8/1917 | Troje |
| 1,252,289 | A | 1/1918 | Murray, Jr. |
| 1,301,135 | A | 4/1919 | Karasick |
| 1,312,546 | A | 8/1919 | Karasick |
| 1,323,546 | A | 8/1919 | Karasick |
| 1,554,236 | A | 1/1920 | Simmons |
| 1,343,751 | A | 6/1920 | Simmons |
| 1,624,741 | A | 12/1926 | Leppke et al. |
| 1,784,256 | A | 12/1930 | Stout |
| 1,895,129 | A | 1/1933 | Jones |
| 2,048,161 | A | 7/1936 | Klaiber |
| 2,147,482 | A | 12/1936 | Butler |
| 2,186,074 | A | 1/1940 | Koller |
| 2,240,035 | A | 4/1941 | Catherall |
| 2,243,555 | A | 5/1941 | Faus |
| 2,269,149 | A | 1/1942 | Edgar |
| 2,327,748 | A | 8/1943 | Smith |
| 2,337,248 | A | 12/1943 | Koller |
| 2,337,249 | A | 12/1943 | Koller |
| 2,389,298 | A | 11/1945 | Ellis |
| 2,401,887 | A | 6/1946 | Sheppard |
| 2,414,653 | A | 1/1947 | Iokholder |
| 2,438,231 | A | 3/1948 | Schultz |
| 2,471,634 | A | 5/1949 | Vennice |
| 2,475,456 | A | 7/1949 | Norlander |
| 2,508,305 | A | 5/1950 | Teetor |
| 2,513,226 | A | 6/1950 | Wylie |
| 2,514,927 | A | 7/1950 | Bernhard |
| 2,520,828 | A | 8/1950 | Bertschi |
| 2,565,624 | A | 8/1951 | phelon |
| 2,570,625 | A | 10/1951 | Zimmerman et al. |
| 2,690,349 | A | 9/1954 | Teetor |
| 2,694,164 | A | 11/1954 | Geppelt |
| 2,964,613 | A | 11/1954 | Williams |
| 2,701,158 | A | 2/1955 | Schmitt |
| 2,722,617 | A | 11/1955 | Cluwen et al. |
| 2,770,759 | A | 11/1956 | Ahlgren |
| 2,837,366 | A | 6/1958 | Loeb |
| 2,853,331 | A | 9/1958 | Teetor |
| 2,888,291 | A | 5/1959 | Scott et al. |
| 2,896,991 | A | 7/1959 | Martin, Jr. |
| 2,932,545 | A | 4/1960 | Foley |
| 2,935,352 | A | 5/1960 | Heppner |
| 2,935,353 | A | 5/1960 | Loeb |
| 2,936,437 | A | 5/1960 | Fraser et al. |
| 2,962,318 | A | 11/1960 | Teetor |
| 3,055,999 | A | 9/1962 | Lucas |
| 3,089,986 | A | 5/1963 | Gauthier |
| 3,102,314 | A | 9/1963 | Alderfer |
| 3,151,902 | A | 10/1964 | Ahlgren |
| 3,204,995 | A | 9/1965 | Teetor |
| 3,208,296 | A | 9/1965 | Baermann |
| 3,238,399 | A | 3/1966 | Johanees et al. |
| 3,273,104 | A | 9/1966 | Krol |
| 3,288,511 | A | 11/1966 | Tavano |
| 3,301,091 | A | 1/1967 | Reese |
| 3,351,368 | A | 11/1967 | Sweet |
| 3,382,386 | A | 5/1968 | Schlaeppi |
| 3,408,104 | A | 10/1968 | Raynes |
| 3,414,309 | A | 12/1968 | Tresemer |
| 3,425,729 | A | 2/1969 | Bisbing |
| 3,468,576 | A | 9/1969 | Beyer et al. |
| 3,474,366 | A | 10/1969 | Barney |
| 3,500,090 | A | 3/1970 | Baermann |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,690,393 | A | 9/1972 | Guy |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,836,801 | A | 9/1974 | Yamashita et al. |
| 3,845,430 | A | 10/1974 | Petkewicz et al. |
| 3,893,059 | A | 7/1975 | Nowak |
| 3,976,316 | A | 8/1976 | Laby |
| 4,079,558 | A | 3/1978 | Gorham |
| 4,117,431 | A | 9/1978 | Eicher |
| 4,129,846 | A | 12/1978 | Yablochnikov |
| 4,209,905 | A | 7/1980 | Gillings |
| 4,222,489 | A | 9/1980 | Hutter |
| 4,296,394 | A | 10/1981 | Ragheb |
| 4,340,833 | A | 7/1982 | Sudo et al. |
| 4,352,960 | A | 10/1982 | Dormer et al. |
| 4,355,236 | A | 10/1982 | Holsinger |
| 4,399,595 | A | 8/1983 | Yoon et al. |
| 4,416,127 | A | 11/1983 | Gomez-Olea Naveda |
| 4,451,811 | A | 5/1984 | Hoffman |
| 4,453,294 | A | 6/1984 | Morita |
| 4,517,483 | A | 5/1985 | Hucker et al. |
| 4,535,278 | A | 8/1985 | Asakawa |
| 4,547,756 | A | 10/1985 | Miller et al. |
| 4,629,131 | A | 12/1986 | Podell |
| 4,645,283 | A | 2/1987 | MacDonald et al. |
| 4,680,494 | A | 7/1987 | Grosjean |
| 4,764,743 | A | 8/1988 | Leupold et al. |
| 4,808,955 | A | 2/1989 | Godkin et al. |
| 4,837,539 | A | 6/1989 | Baker |
| 4,849,749 | A | 7/1989 | Fukamachi et al. |
| 4,862,128 | A | 8/1989 | Leupold |
| H693 | H | 10/1989 | Leupold |
| 4,893,103 | A | 1/1990 | Leupold |
| 4,912,727 | A | 3/1990 | Schubert |
| 4,941,236 | A | 7/1990 | Sherman et al. |
| 4,956,625 | A | 9/1990 | Cardone et al. |
| 4,980,593 | A | 12/1990 | Edmundson |
| 4,993,950 | A | 2/1991 | Mensor, Jr. |
| 4,994,778 | A | 2/1991 | Leupold |
| 4,996,457 | A | 2/1991 | Hawsey et al. |
| 5,013,949 | A | 5/1991 | Mabe, Jr. |
| 5,020,625 | A | 6/1991 | Yamauchi et al. |
| 5,050,276 | A | 9/1991 | Pemberton |
| 5,062,855 | A | 11/1991 | Rincoe |
| 5,123,843 | A | 6/1992 | Van der Zel et al. |
| 5,179,307 | A | 1/1993 | Porter |
| 5,190,325 | A | 3/1993 | Doss-Desouza |
| 5,213,307 | A | 5/1993 | Perrillat-Amede |
| 5,302,929 | A | 4/1994 | Kovacs |
| 5,309,680 | A | 5/1994 | Kiel |
| 5,345,207 | A | 9/1994 | Gebele |
| 5,349,258 | A | 9/1994 | Leupold et al. |
| 5,367,891 | A | 11/1994 | Furuyama |
| 5,383,049 | A | 1/1995 | Carr |
| 5,394,132 | A | 2/1995 | Poil |
| 5,399,933 | A | 3/1995 | Tsai |
| 5,425,763 | A | 6/1995 | Stemmann |
| 5,440,997 | A | 8/1995 | Crowley |
| 5,461,386 | A | 10/1995 | Knebelkamp |
| 5,485,435 | A | 1/1996 | Matsuda et al. |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,582,522 | A | 12/1996 | Johnson |
| 5,604,960 | A | 2/1997 | Good |
| 5,631,093 | A | 5/1997 | Perry et al. |
| 5,631,618 | A | 5/1997 | Trumper et al. |
| 5,633,555 | A | 5/1997 | Ackermann et al. |
| 5,635,889 | A | 6/1997 | Stelter |
| 5,637,972 | A | 6/1997 | Randall et al. |
| 5,730,155 | A | 3/1998 | Allen |
| 5,742,036 | A | 4/1998 | Schramm, Jr. et al. |
| 5,759,054 | A | 6/1998 | Spadafore |
| 5,788,493 | A | 8/1998 | Tanaka et al. |

(56) References Cited

U.S. PATENT DOCUMENTS 5,838,304 A 11/1998 Hall
5,852,393 A 12/1998 Reznik et al.
5,935,155 A 8/1999 Humayun et al.
5,956,778 A 9/1999 Godoy
5,983,406 A 11/1999 Meyerrose
6,000,484 A 12/1999 Zoretich et al.
6,039,759 A 3/2000 Carpentier et al.
6,047,456 A 4/2000 Yao et al.
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A 9/2000 Cousins
6,125,955 A 10/2000 Zoretich et al.
6,142,779 A 11/2000 Siegel et al.
6,170,131 B1 1/2001 Shin
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 5/2001 Tsai et al.
6,241,069 B1 6/2001 Mazur et al.
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,422,533 B1 7/2002 Harms
6,457,179 B1 10/2002 Prendergast
6,467,326 B1 10/2002 Garrigus
6,535,092 B1 3/2003 Hurley et al.
6,540,515 B1 4/2003 Tanaka
6,561,815 B1 5/2003 Schmidt
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,821,126 B2 11/2004 Neidlein
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 3/2005 Perrin
6,913,471 B2 7/2005 Smith
6,927,657 B1 8/2005 Wu
6,936,937 B2 8/2005 Tu et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,038,565 B1 5/2006 Chell
7,065,860 B2 6/2006 Aoki et al.
7,066,739 B2 6/2006 McLeish
7,066,778 B2 6/2006 Kretzschmar
7,097,461 B2 8/2006 Neidlein
7,101,374 B2 9/2006 Hyde, Jr.
7,135,792 B2 11/2006 Devaney et al.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,311,526 B2 12/2007 Rohrbach et al.
7,339,790 B2 3/2008 Baker et al.
7,344,380 B2 3/2008 Neidlein et al.
7,351,066 B2 4/2008 DiFonzo et al.
7,358,724 B2 4/2008 Taylor et al.
7,362,018 B1 4/2008 Kulogo et al.
7,364,433 B2 4/2008 Neidlein
7,381,181 B2 6/2008 Lau et al.
7,402,175 B2 7/2008 Azar
7,416,414 B2 8/2008 Bozzone et al.
7,438,726 B2 10/2008 Erb
7,444,683 B2 11/2008 Prendergast et al.
7,453,341 B1 11/2008 Hildenbrand
7,467,948 B2 12/2008 Lindberg et al.
7,498,914 B2 3/2009 Miyashita et al.
7,583,500 B2 9/2009 Ligtenberg et al.
7,637,746 B2 12/2009 Lindberg et al.
7,645,143 B2 1/2010 Rohrbach et al.
7,658,613 B1 2/2010 Griffin et al.
7,715,890 B2 5/2010 Kim et al.
7,762,817 B2 7/2010 Ligtenberg et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 10/2010 Fullerton et al.
7,817,004 B2 10/2010 Fullerton et al.
7,828,556 B2 11/2010 Rodrigues
7,832,897 B2 11/2010 Ku
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,871,272 B2 1/2011 Firman, II et al.
7,874,856 B1 1/2011 Schriefer et al.
7,889,037 B2 2/2011 Cho
7,901,216 B2 3/2011 Rohrbach et al.
7,903,397 B2 3/2011 McCoy
7,905,626 B2 3/2011 Shantha et al.
7,997,906 B2 8/2011 Ligenberg et al.
8,002,585 B2 8/2011 Zhou
8,009,001 B1 8/2011 Cleveland
8,050,714 B2 11/2011 Fadell et al.
8,078,224 B2 12/2011 Fadell et al.
8,078,776 B2 12/2011 Novotney et al.
8,087,939 B2 1/2012 Rohrbach et al.
8,099,964 B2 1/2012 Saito et al.
8,138,869 B1 3/2012 Lauder et al.
8,143,982 B1 3/2012 Lauder et al.
8,143,983 B1 3/2012 Lauder et al.
8,165,634 B2 4/2012 Fadell et al.
8,177,560 B2 5/2012 Rohrbach et al.
8,187,006 B2 5/2012 Rudisill et al.
8,190,205 B2 5/2012 Fadell et al.
8,242,868 B2 8/2012 Lauder et al.
8,253,518 B2 8/2012 Lauder et al.
8,264,310 B2 9/2012 Lauder et al.
8,264,314 B2 9/2012 Sankar
8,271,038 B2 9/2012 Fadell et al.
8,271,705 B2 9/2012 Novotney et al.
8,297,367 B2 10/2012 Chen et al.
8,344,836 B2 1/2013 Lauder et al.
8,348,678 B2 1/2013 Hardisty et al.
8,354,767 B2 1/2013 Pennander et al.
8,390,411 B2 3/2013 Lauder et al.
8,390,412 B2 3/2013 Lauder et al.
8,390,413 B2 3/2013 Lauder et al.
8,395,465 B2 3/2013 Lauder et al.
8,398,409 B2 3/2013 Schmidt
8,435,042 B2 5/2013 Rohrbach et al.
8,454,372 B2 6/2013 Lee
8,467,829 B2 6/2013 Fadell et al.
8,497,753 B2 7/2013 DiFonzo et al.
8,514,042 B2 8/2013 Lauder et al.
8,535,088 B2 9/2013 Gao et al.
8,576,031 B2 11/2013 Lauder et al.
8,576,034 B2 11/2013 Bilbrey et al.
8,616,362 B1 12/2013 Browne et al.
8,648,679 B2 2/2014 Lauder et al.
8,665,044 B2 3/2014 Lauder et al.
8,665,045 B2 3/2014 Lauder et al.
8,690,582 B2 4/2014 Rohrbach et al.
8,702,316 B2 4/2014 DiFonzo et al.
8,734,024 B2 5/2014 Isenhour et al.
8,752,200 B2 6/2014 Varshavsky et al.
8,757,893 B1 6/2014 Isenhour et al.

(56) References Cited

U.S. PATENT DOCUMENTS

| | | | |
|---|---|---|---|
| 8,770,857 | B2 | 7/2014 | DiFonzo et al. |
| 8,774,577 | B2 | 7/2014 | Benjamin et al. |
| 8,781,273 | B2 | 7/2014 | Benjamin et al. |
| 2002/0125977 | A1 | 9/2002 | VanZoest |
| 2003/0136837 | A1 | 7/2003 | Amon et al. |
| 2003/0170976 | A1 | 9/2003 | Molla et al. |
| 2003/0179880 | A1 | 9/2003 | Pan et al. |
| 2003/0187510 | A1 | 10/2003 | Hyde |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0196484 | A1 | 9/2005 | Khoshnevis |
| 2005/0231046 | A1 | 10/2005 | Aoshima |
| 2005/0240263 | A1 | 10/2005 | Fogarty et al. |
| 2005/0263549 | A1 | 12/2005 | Scheiner |
| 2005/0283839 | A1 | 12/2005 | Cowburn |
| 2006/0066428 | A1 | 3/2006 | McCarthy et al. |
| 2006/0189259 | A1 | 8/2006 | Park et al. |
| 2006/0198047 | A1 | 9/2006 | Xue et al. |
| 2006/0198998 | A1 | 9/2006 | Raksha et al. |
| 2006/0214756 | A1 | 9/2006 | Elliott et al. |
| 2006/0290451 | A1 | 12/2006 | Prendergast et al. |
| 2006/0293762 | A1 | 12/2006 | Schulman et al. |
| 2007/0072476 | A1 | 3/2007 | Milan |
| 2007/0075594 | A1 | 4/2007 | Sadler |
| 2007/0103266 | A1 | 5/2007 | Wang et al. |
| 2007/0138806 | A1 | 6/2007 | Ligtenberg et al. |
| 2007/0255400 | A1 | 11/2007 | Parravicini et al. |
| 2007/0267929 | A1 | 11/2007 | Pulnikov et al. |
| 2008/0119250 | A1 | 5/2008 | Cho et al. |
| 2008/0139261 | A1 | 6/2008 | Cho et al. |
| 2008/0174392 | A1 | 7/2008 | Cho |
| 2008/0181804 | A1 | 7/2008 | Tanigawa et al. |
| 2008/0186683 | A1 | 8/2008 | Ligtenberg et al. |
| 2008/0218299 | A1 | 9/2008 | Arnold |
| 2008/0224806 | A1 | 9/2008 | Ogden et al. |
| 2008/0272868 | A1 | 11/2008 | Prendergast et al. |
| 2008/0282517 | A1 | 11/2008 | Claro |
| 2009/0021333 | A1 | 1/2009 | Fiedler |
| 2009/0209173 | A1 | 8/2009 | Arledge et al. |
| 2009/0250576 | A1 | 10/2009 | Fullerton et al. |
| 2009/0251256 | A1 | 10/2009 | Fullerton et al. |
| 2009/0254196 | A1 | 10/2009 | Cox et al. |
| 2009/0278642 | A1 | 11/2009 | Fullerton et al. |
| 2009/0289090 | A1 | 11/2009 | Fullerton et al. |
| 2009/0289749 | A1 | 11/2009 | Fullerton et al. |
| 2009/0292371 | A1 | 11/2009 | Fullerton et al. |
| 2010/0033280 | A1 | 2/2010 | Bird et al. |
| 2010/0126857 | A1 | 5/2010 | Polwart et al. |
| 2010/0167576 | A1 | 7/2010 | Zhou |
| 2011/0026203 | A1 | 2/2011 | Ligtenberg et al. |
| 2011/0085157 | A1 | 4/2011 | Bloss et al. |
| 2011/0101088 | A1 | 5/2011 | Marguerettaz et al. |
| 2011/0210636 | A1 | 9/2011 | Kuhlmann-Wilsdorf |
| 2011/0234344 | A1 | 9/2011 | Fullerton et al. |
| 2011/0248806 | A1 | 10/2011 | Michael |
| 2011/0279206 | A1 | 11/2011 | Fullerton et al. |
| 2012/0007704 | A1 | 1/2012 | Nerl |
| 2012/0064309 | A1 | 3/2012 | Kwon et al. |
| 2012/0085753 | A1 | 4/2012 | Fitch et al. |
| 2012/0235519 | A1 | 9/2012 | Dyer et al. |
| 2013/0001745 | A1 | 1/2013 | Iwaki |
| 2013/0186209 | A1 | 7/2013 | Herbst |
| 2013/0186473 | A1 | 7/2013 | Mankame et al. |
| 2013/0186807 | A1 | 7/2013 | Browne et al. |
| 2013/0187538 | A1 | 7/2013 | Herbst |
| 2013/0192860 | A1 | 8/2013 | Puzio et al. |
| 2013/0207758 | A1 | 8/2013 | Browne et al. |
| 2013/0252375 | A1 | 9/2013 | Yi et al. |
| 2013/0256274 | A1 | 10/2013 | Faulkner |
| 2013/0270056 | A1 | 10/2013 | Mankame et al. |
| 2013/0305705 | A1 | 11/2013 | Ac et al. |
| 2013/0341137 | A1 | 12/2013 | Mandame et al. |
| 2014/0044972 | A1 | 2/2014 | Menassa et al. |
| 2014/0072261 | A1 | 3/2014 | Isenhour et al. |
| 2014/0152252 | A1 | 6/2014 | Wood et al. |
| 2014/0205235 | A1 | 7/2014 | Benjamin et al. |
| 2014/0221741 | A1 | 8/2014 | Wang et al. |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | A | 1/1938 |
| GB | 1 495 677 | A | 12/1977 |
| JP | S57-55908 | U | 4/1982 |
| JP | S57-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2008035676 | A | 2/2008 |
| JP | 2008165974 | A | 7/2008 |
| JP | 05-038123 | B2 | 10/2012 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

BNS 33 Range, Magnetic safety sensors, Rectangular design, http://www.farnell.com/datasheets/36449.pdf, 3 pages, date unknown.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion dated Jun. 1, 2009, directed to counterpart application No. PCT/US2009/002027. (10 pages).

International Search Report and Written Opinion of the International Searching Authority issued in Application No. PCT/US12/61938 dated Feb. 26, 2013.

(56) References Cited

OTHER PUBLICATIONS

International Search Report and Written Opinion of the International Searching Authority issued in Application No. PCT/US2013/028095 dated May 13, 2013.
International Search Report and Written Opinion of the International Searching Authority issued in Application No. PCT/US2013/047986 dated Nov. 21, 2013.
International Search Report and Written Opinion, dated Apr. 8, 2011 issued in related International Application No. PCT/US2010/049410.
International Search Report and Written Opinion, dated Aug. 18, 2010, issued in related International Application No. PCT/US2010/036443.
International Search Report and Written Opinion, dated Jul. 13, 2010, issued in related International Application No. PCT/US2010/021612.
International Search Report and Written Opinion, dated May 14, 2009, issued in related International Application No. PCT/US2009/038925.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Kim, "A future cost trends of magnetizer systems in Korea", Industrial Electronics, Control, and Instrumentation, 1996, vol. 2, Aug. 5, 1996, pp. 991-996.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-47.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Series BNS, Compatible Series AES Safety Controllers, http://www.schmersalusa.com/safety_controllers/drawings/aes.pdf, pp. 159-175, date unknown.
Series BNS-B20, Coded-Magnet Sensorr Safety Door Handle, http://www.schmersalusa.com/catalog_pdfs/BNS_B20.pdf, 2pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/246,584 dated May 16, 2013.
United States Office Action issued in U.S. Appl. No. 13/246,584 dated Oct. 15, 2013.
United States Office Action issued in U.S. Appl. No. 13/374,074 dated Feb. 21, 2013.
United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,270.
United States Office Action, dated Feb. 2, 2011, issued in counterpart U.S. Appl. No. 12/476,952.
United States Office Action, dated Mar. 12, 2012, issued in counterpart U.S. Appl. No. 12/206,270.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.
C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog No. CFP1290B-PRT, ISBN: 978-1-4673-0143-5.
V. Rudnev, An Objective Assessment of Magnetic Flux Concentrators, HET Trating Progress, Nov./Dec. 2004, p. 19-23.

FIG. 3B
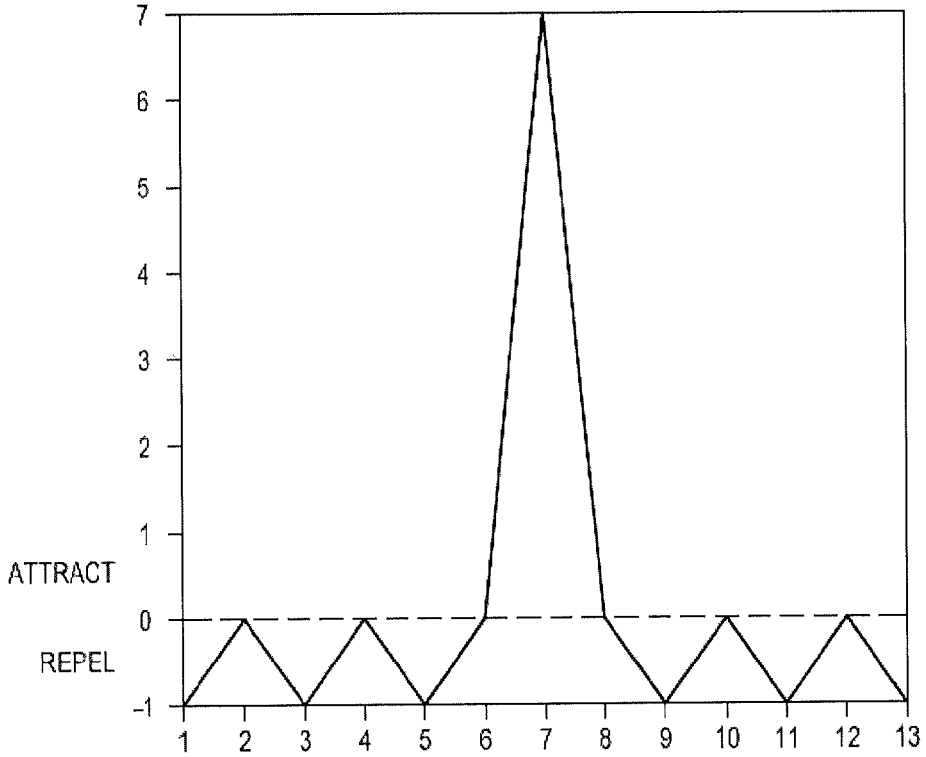
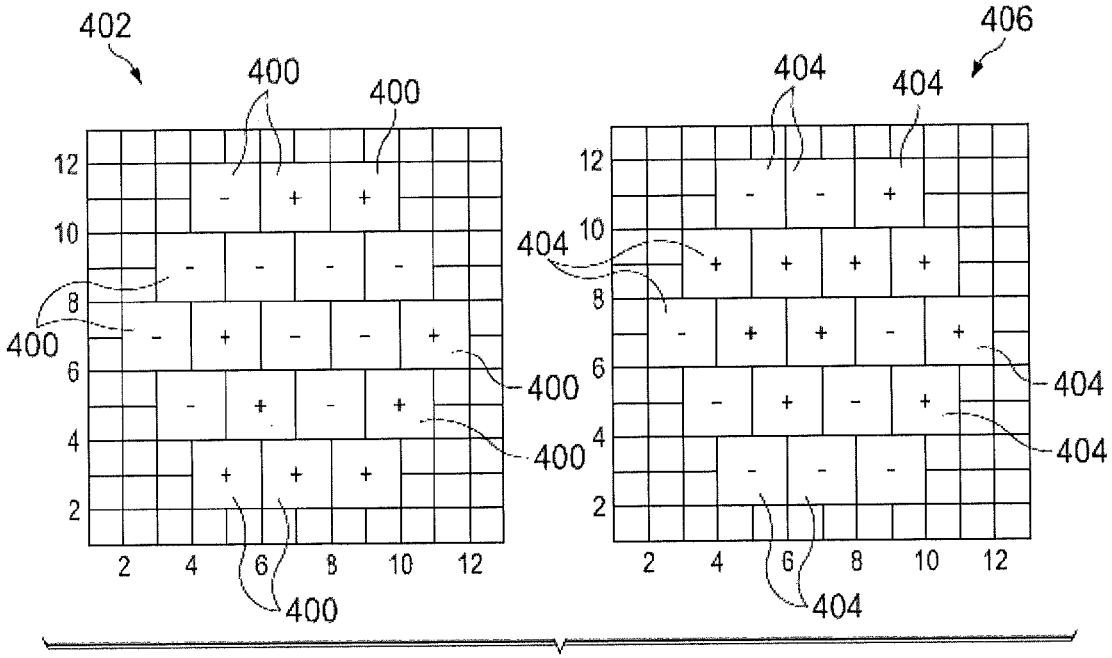
FIG. 4A

SYSTEM AND METHOD FOR MOVING AN OBJECT

RELATED APPLICATIONS

This non-provisional application is a continuation of non-provisional application Ser. No. 13/104,393, titled "A System and Method for Moving an Object", filed May 10, 2011, which claims the benefit under 35 USC 119(e) of prior provisional application 61/395,205, titled "A System and Method for Moving an Object", filed May 10, 2010 by Fullerton et al, which are each incorporated by reference in their entirety herein.

This non-provisional application is related to U.S. Pat. Nos. 7,800,471, 7,868,721, 7,961,068, and 8,179,219, which are each incorporated by reference in their entirety herein.

FIELD OF THE INVENTION

The present invention relates generally to a system and method for moving an object. More particularly, the present invention relates to a system and method for using a first magnetic structure associated with a first object and a second magnetic structure associated with a second object to cause the second object to move relative to the first object.

BACKGROUND OF THE INVENTION

Traditionally, permanent magnets have not been a practical means for moving a first object with a second magnetically attached object for applications where the direction of movement of the first object is perpendicular to the direction of magnetization of the magnets unless an electromagnetic field is applied to the permanent magnets to effect their magnetic properties. Because shear forces between two magnets or between a magnet and metal are low compared to tensile forces, the size of the magnet(s) required to achieve shear forces necessary to maintain attachment of two objects during such movement makes them impractical due to size, weight, cost, and safety reasons. For example, magnets strong enough to attach a blade of a blender or food processor would need to be substantially large to maintain attachment of the blade during normal use of the appliance and would therefore be very difficult to remove, expensive, and generally unsafe in a kitchen environment where lots of metal is present such as stove tops, utensils, and even the blade itself.

Magnetic drives involving electromagnetic fields and permanent magnets have been used to magnetically attach a magnetic structure to magnetizable material associated with blades in blenders, for example, as described in U.S. Pat. No. 6,210,033, to Karkos et al. Such magnetic drives require a rotating electromagnetic field to be produced and maintained to enable attachment of the magnetic structure to the magnetizable material during operation of the blender.

Therefore, it is desirable to provide improved systems and methods for moving an object using magnetic structures that do not require electromagnetic fields to be produced.

SUMMARY OF THE INVENTION

One embodiment of the invention includes a method for moving an object comprising the steps of associating a first magnetic structure with a first object, associating a second magnetic structure with a second object, said first magnetic structure and said second magnetic structure having a spatial force function in accordance with a code, achieving complementary alignment and peak correlation of said first magnetic structure with said second magnetic structure to produce a peak tensile force enabling magnetic attachment of said first object to said second object, said first magnetic structure and said second magnetic structure also producing a shear force, and moving said second object by moving said first object, said shear force preventing misalignment and decorrelation of said first magnetic structure and said second magnetic structure until an amount of torque greater than a torque threshold is applied to said first object.

The code may correspond to a code modulo of the first magnetic structure and a complementary code modulo of the second magnetic structure, the code defines a peak spatial force corresponding to substantial alignment of the code modulo of the first magnetic structure with the complementary code modulo of the second magnetic structure, the code also defines a plurality of off peak spatial forces corresponding to a plurality of different misalignments of the code modulo of the first magnetic structure and the complementary code modulo of the second magnetic structure, the plurality of off peak spatial forces having a largest off peak spatial force, and the largest off peak spatial force is less than half of the peak spatial force.

At least one of the first magnetic structure or the second magnetic structure can be configured to rotate about a pivot point, where a range or rotation can be limited.

The method may further comprise the steps of associating a first secondary magnet structure with said first object and associating a second secondary magnet structure with said second object, said first and second secondary magnetic structures providing additional shear force between said first and second object.

The first object may comprise a motor. The second object may comprise a blade.

The first object and said second object may correspond to one of a blender, food processor, mixer, lawnmower, or bush hog.

Under one arrangement, rotating the first object rotates the second object.

Under another arrangement, the first magnetic structure and the second magnetic structure are ring magnetic structures.

A second embodiment of the invention includes a system for moving an object comprising a first magnetic structure associated with a first object and a second magnetic structure associated with a second object, the first magnetic structure and the second magnetic structure having a spatial force function in accordance with a code, the first magnetic structure with the second magnetic structure being in a complementary alignment resulting in a peak correlation and producing a peak tensile force enabling magnetic attachment of the first object to the second object, the first magnetic structure and the second magnetic structure also producing a shear force that prevents misalignment and decorrelation of the first magnetic structure and the second magnetic structure until an amount of torque greater than a torque threshold is applied to said first object.

The code corresponds to a code modulo of the first magnetic structure and a complementary code modulo of the second magnetic structure where the code defines a peak spatial force corresponding to substantial alignment of the code modulo of the first magnetic structure with the complementary code modulo of the second magnetic structure, the code also defines a plurality of off peak spatial forces corresponding to a plurality of different misalignments of the code modulo of the first magnetic structure and the complementary code modulo of the second magnetic structure, the plurality of off peak spatial forces having a largest off peak spatial force, and the largest off peak spatial force is less than half of the peak spatial force.

At least one of the first magnetic structure or the second magnetic structure can be configured to rotate about a pivot point, where a range or rotation is limited.

The system may further comprise a first secondary magnet structure associated with the first object and a second secondary magnet structure associated with the second object, the first and second secondary magnetic structures providing additional shear force between the first and second object.

The first object may comprise a motor. The second object may comprise a blade.

The first object and the second object can correspond to one of a blender, food processor, mixer, lawnmower, or bush hog.

Rotating the first object may cause rotation of the second object.

The first magnetic structure and the second magnetic structure can be ring magnetic structures.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
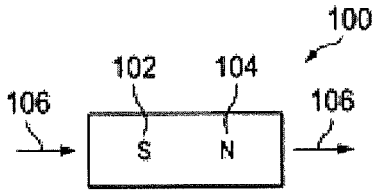
FIGS. 1-9 are various diagrams used to help explain different concepts about correlated magnetic technology which can be utilized in an embodiment of the present invention.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides a system and method for moving an object. It involves coded magnetic structure techniques related to those described in U.S. patent application Ser. No. 12/476,952, filed Jun. 2, 2009, and U.S. Provisional Patent Application 61/277,214, titled "A System and Method for Contactless Attachment of Two Objects", filed Sep. 22, 2009, and U.S. Provisional Patent Application 61/278,900, titled "A System and Method for Contactless Attachment of Two Objects", filed Sep. 30, 2009, and U.S. Provisional Patent Application 61/278,767 titled "A System and Method for Contactless Attachment of Two Objects", filed Oct. 9, 2009, U.S. Provisional Patent Application 61/280,094, titled "A System and Method for Producing Multi-level Magnetic Fields", filed Oct. 16, 2009, U.S. Provisional Patent Application 61/281,160, titled "A System and Method for Producing Multi-level Magnetic Fields", filed Nov. 13, 2009, U.S. Provisional Patent Application 61/283,780, titled "A System and Method for Producing Multi-level Magnetic Fields", filed Dec. 9, 2009, and U.S. Provisional Patent Application 61/284,385, titled "A System and Method for Producing Multi-level Magnetic Fields", filed Dec. 17, 2009, and U.S. Provisional Patent Application titled "A System and Method for Producing Multi-level Magnetic Fields", filed Apr. 22, 2010, Application No. 61/342,988, which are all incorporated herein by reference in their entirety. Such systems and methods described in U.S. patent application Ser. No. 12/322,561, filed Feb. 4, 2009, U.S. patent application Ser. Nos. 12/479,074, 12/478,889, 12/478,939, 12/478,911, 12/478,950, 12/478,969, 12/479,013, 12/479,073, 12/479,106, filed Jun. 5, 2009, U.S. patent application Ser. Nos. 12/479,818, 12/479,820, 12/479,832, and 12/479,832, file Jun. 7, 2009, U.S. patent application Ser. No. 12/494,064, filed Jun. 29, 2009, U.S. patent application Ser. No. 12/495,462, filed Jun. 30, 2009, U.S. patent application Ser. No. 12/496,463, filed Jul. 1, 2009, U.S. patent application Ser. No. 12/499,039, filed Jul. 7, 2009, U.S. patent application Ser. No. 12/501,425, filed Jul. 11, 2009, and U.S. patent application Ser. No. 12/507,015, filed Jul. 21, 2009 are all incorporated by reference herein in their entirety.

Correlated Magnetics Technology

This section is provided to introduce the reader to basic magnets and the new and revolutionary correlated magnetic technology. This section includes subsections relating to basic magnets, correlated magnets, and correlated electromagnetics. It should be understood that this section is provided to assist the reader with understanding the present invention, and should not be used to limit the scope of the present invention.

A. Magnets

A magnet is a material or object that produces a magnetic field which is a vector field that has a direction and a magnitude (also called strength). Referring to FIG. 1, there is illustrated an exemplary magnet 100 which has a South pole 102 and a North pole 104 and magnetic field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively.

Figure 2A:
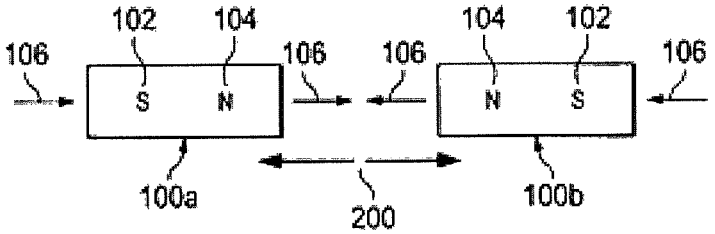
Figure 2B:
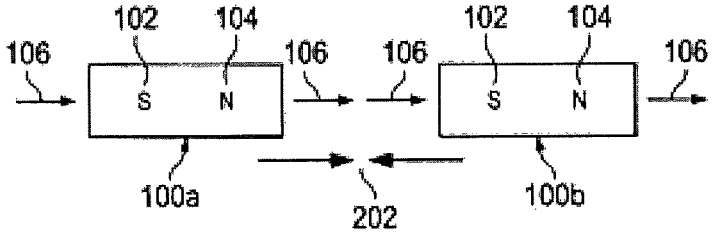
Figure 2C:
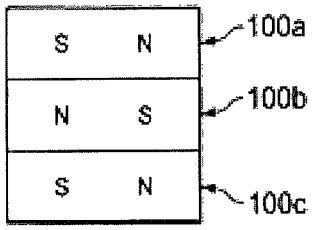

Referring to FIG. 2A, there is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aligned with one another but they can also be partially aligned with one another where they could still "stick" to each other and maintain their positions relative to each other. FIG. 2C is a diagram that illustrates how magnets 100*a*, 100*b* and 100*c* will naturally stack on one another such that their poles alternate.

B. Correlated Magnets

Correlated magnets can be created in a wide variety of ways depending on the particular application as described in the aforementioned U.S. Pat. Nos. 7,800,471 and 7,868,721 and U.S. patent application Ser. No. 12/476,952 by using a unique combination of magnet arrays (referred to herein as magnetic field emission sources or magnetic sources), correlation theory (commonly associated with probability theory and statistics) and coding theory (commonly associated with communication systems). A brief discussion is provided next to explain how these widely diverse technologies are used in a unique and novel way to create correlated magnets.

Basically, correlated magnets are made from a combination of magnetic (or electric) field emission sources which have been configured in accordance with a pre-selected code having desirable correlation properties. Thus, when a magnetic field emission structure (or magnetic structure) is brought into alignment with a complementary, or mirror image, magnetic field emission structure the various magnetic field emission sources will all align causing a peak spatial attraction force to be produced, while the misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources all align causing a peak spatial repelling force to be produced, while the misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions can be used to achieve precision alignment and precision positioning not possible with basic magnets. Moreover, the spatial force functions can enable the precise control of magnetic fields and associated spatial forces thereby enabling new forms of attachment devices for attaching objects with precise alignment and new systems and methods for controlling precision movement of objects. An additional unique characteristic associated with correlated magnets relates to the situation where the various magnetic field sources making-up two magnetic field emission structures can effectively cancel out each other when they are brought out of alignment which is described herein as a release force. This release force is a direct result of the particular correlation coding used to configure the magnetic field emission structures.

A person skilled in the art of coding theory will recognize that there are many different types of codes that have different correlation properties which have been used in communications for channelization purposes, energy spreading, modulation, and other purposes. Many of the basic characteristics of such codes make them applicable for use in producing the magnetic field emission structures described herein. For example, Barker codes are known for their autocorrelation properties and can be used to help configure correlated magnets. Although, a Barker code is used in an example below with respect to FIGS. 3A-3B, other forms of codes which may or may not be well known in the art are also applicable to correlated magnets because of their autocorrelation, cross-correlation, or other properties including, for example, Gold codes, Kasami sequences, hyperbolic congruential codes, quadratic congruential codes, linear congruential codes, Welch-Costas array codes, Golomb-Costas array codes, pseudorandom codes, chaotic codes, Optimal Golomb Ruler codes, deterministic codes, designed codes, one dimensional codes, two dimensional codes, three dimensional codes, or four dimensional codes, combinations thereof, and so forth.

Figure 3A:
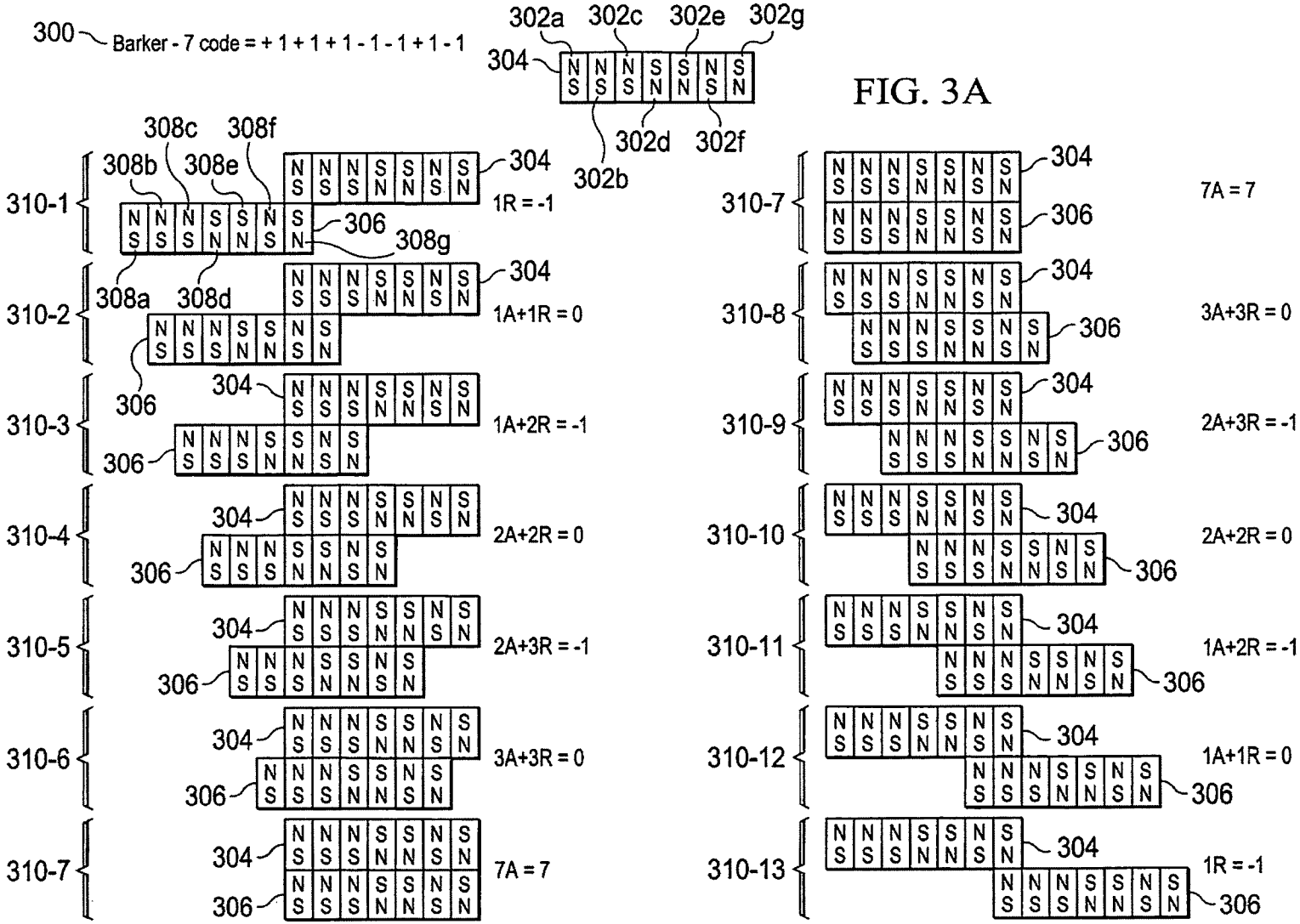

Referring to FIG. 3A, there are diagrams used to explain how a Barker length 7 code 300 can be used to determine polarities and positions of magnets 302*a*, 302*b* . . . 302*g* making up a first magnetic field emission structure 304. Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). A second magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnets that repel plus the number of magnets that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*. With the specific Barker code used, the spatial force varies from −1 to 7, where the peak occurs when the two magnetic field emission structures 304 and 306 are aligned which occurs when their respective codes are aligned. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa). In other words, the two magnetic field emission structures 304 and 306 substantially correlate with one another when they are aligned to substantially mirror each other.

In FIG. 3B, there is a plot that depicts the spatial force function of the two magnetic field emission structures 304 and 306 which results from the binary autocorrelation function of the Barker length 7 code 300, where the values at each alignment position 1 through 13 correspond to the spatial force values that were calculated for the thirteen alignment positions 310-1 through 310-13 between the two magnetic field emission structures 304 and 306 depicted in FIG. 3A. As the true autocorrelation function for correlated magnet field structures is repulsive, and most of the uses envisioned will have attractive correlation peaks, the usage of the term 'autocorrelation' herein will refer to complementary correlation unless otherwise stated. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

Figure 4B:
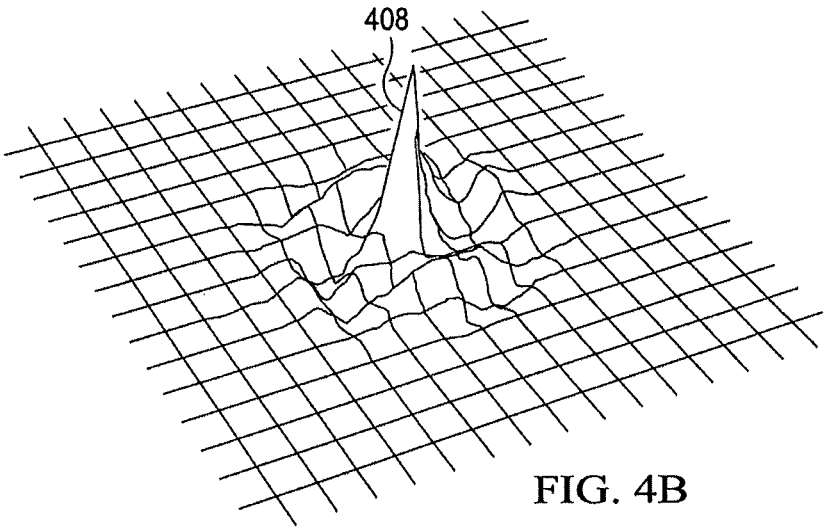
Figure 4C:
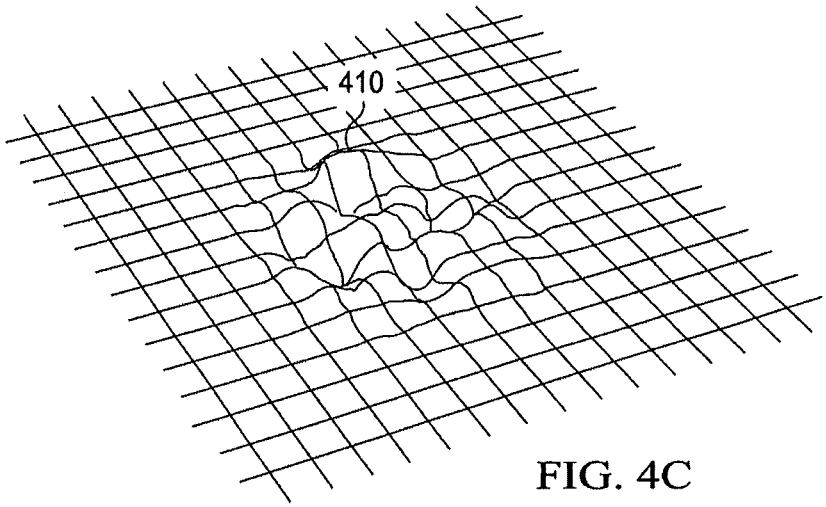

Referring to FIG. 4A, there is a diagram of an array of 19 magnets 400 positioned in accordance with an exemplary code to produce an exemplary magnetic field emission structure 402 and another array of 19 magnets 404 which is used to produce a mirror image magnetic field emission structure 406. In this example, the exemplary code was intended to produce the first magnetic field emission structure 402 to have a first stronger lock when aligned with its mirror image magnetic field emission structure 406 and a second weaker lock when it is rotated 90° relative to its mirror image magnetic field emission structure 406. FIG. 4B depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions then they could be easily separated.

Figure 5:
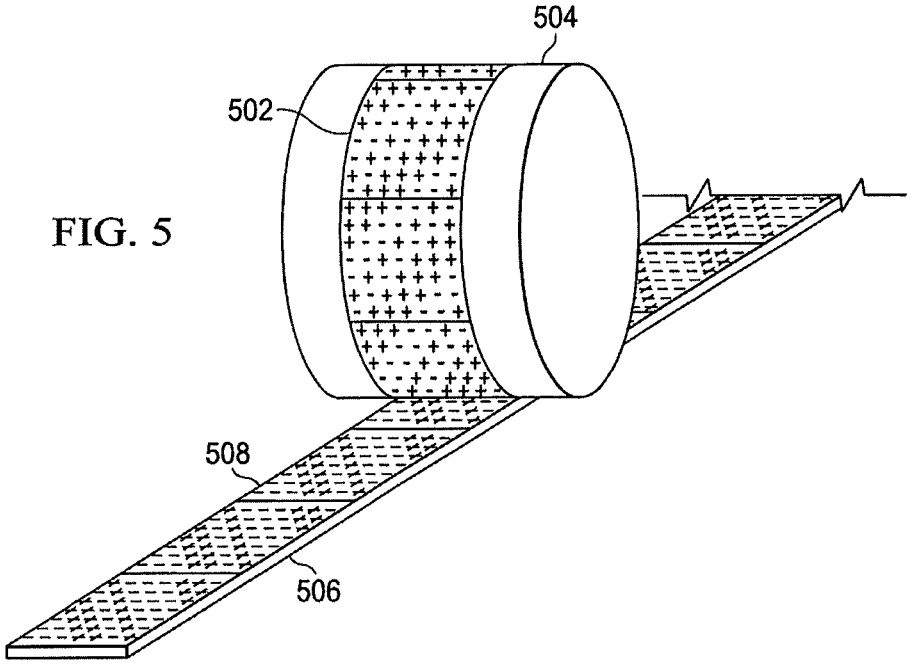

Referring to FIG. 5, there is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force would remain substantially constant as the cylinder 504 moved down the conveyor belt/tracked structure 506 independent of friction or gravity and could therefore be used to move an object about a track that moved up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 is largely independent of the friction forces between the traction wheel and the traction surface and can be employed with low friction surfaces. Devices moving about based on magnetic traction can be operated independently of gravity for example in weightless conditions including space, underwater, vertical surfaces and even upside down.

Figure 6:
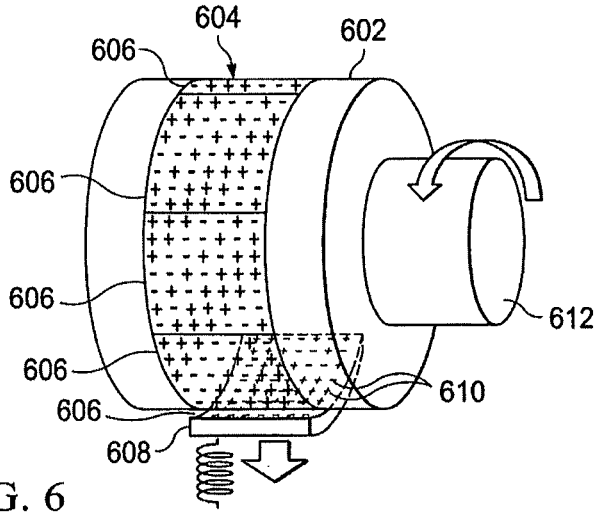

Referring to FIG. 6, there is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume, the cylinder 602 is turned at a rotational rate of 1 rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then 6 times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610. One skilled in the art will recognize that the cylinder 602 may be connected to a shaft 612 which may be turned as a result of wind turning a windmill, a water wheel or turbine, ocean wave movement, and other methods whereby movement of the object 608 can result from some source of energy scavenging. As such, correlated magnets enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, etc. . . . . In other cases, magnets of the same magnetic field emission structure could be sparsely separated from other magnets (e.g., in a sparse array) such that the magnetic forces of the individual magnets do not substantially interact, in which case the polarity of individual magnets can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align but these magnets can be made to remain in a desired orientation by use of a holding mechanism such as an adhesive, a screw, a bolt & nut, etc. . . . . As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, and a structural assembly.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

Figure 7:
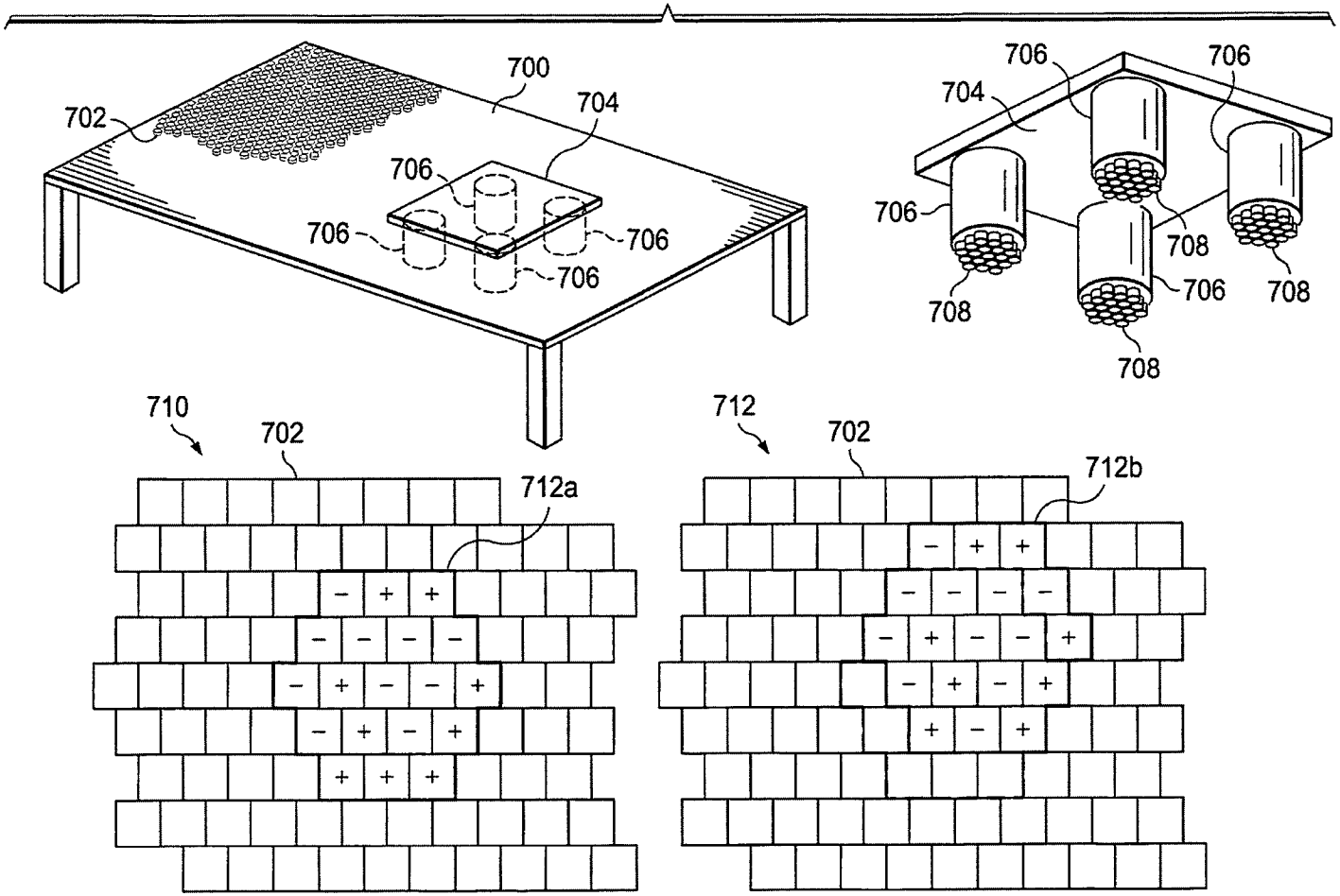

Referring to FIG. 7, there are several diagrams used to explain a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts states of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, one skilled in the art can recognize that the table contact member(s) 706 can be moved about table 700 by varying the states of the electromagnets of the electromagnetic array 702.

Figure 8:
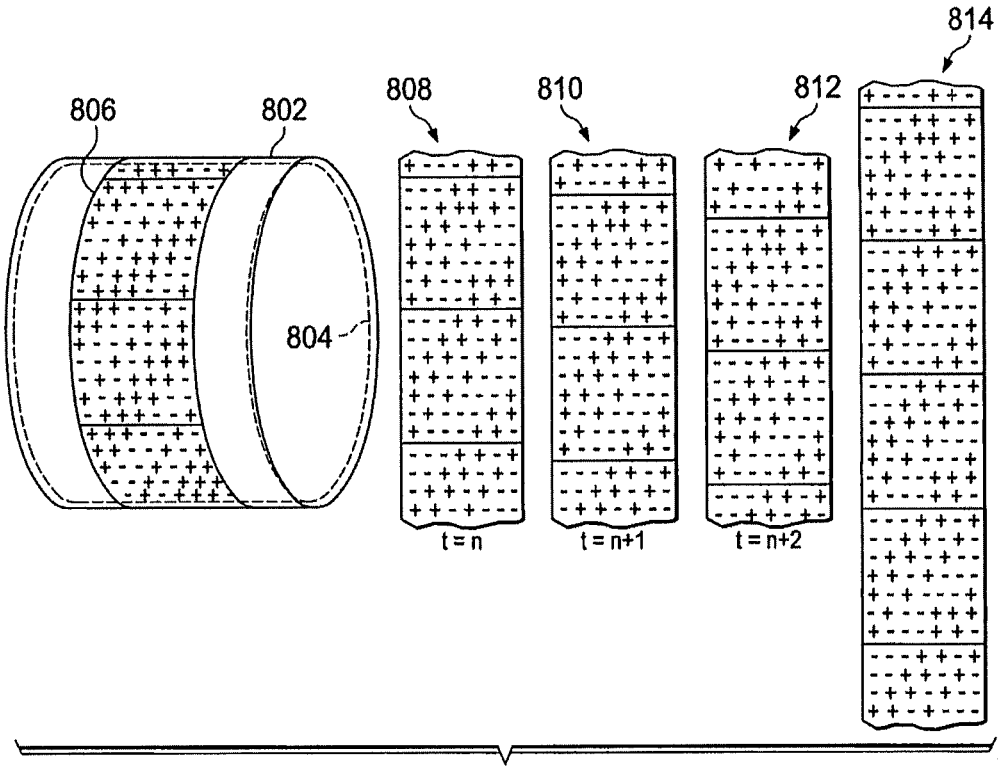

Referring to FIG. 8, there are several diagrams used to explain a 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
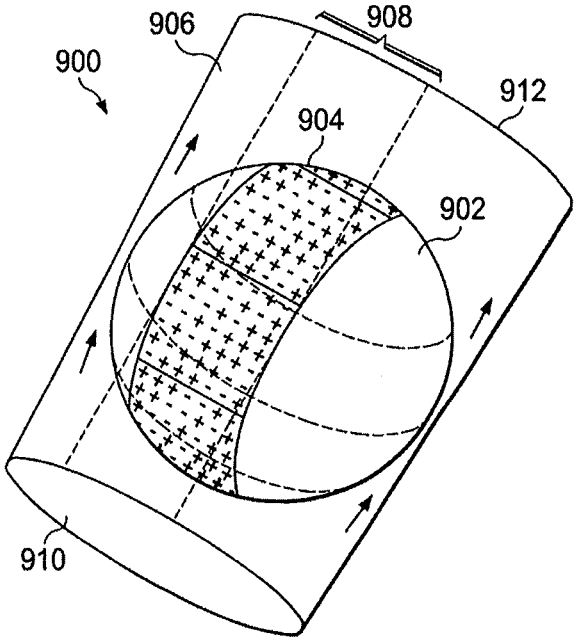

Referring to FIG. 9, there is illustrated an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve. Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. One skilled in the art will recognize that many different types of seal mechanisms that include gaskets, o-rings, and the like can be employed with the use of the correlated magnets. Plus, one skilled in the art will recognize that the magnetic field emission structures can have an array of sources including, for example, a permanent magnet, an electromagnet, an electret, a magnetized ferromagnetic material, a portion of a magnetized ferromagnetic material, a soft magnetic material, or a superconductive magnetic material, some combination thereof, and so forth.

Moving a Second Object Magnetically Attached to a First Object

Figure 10B:
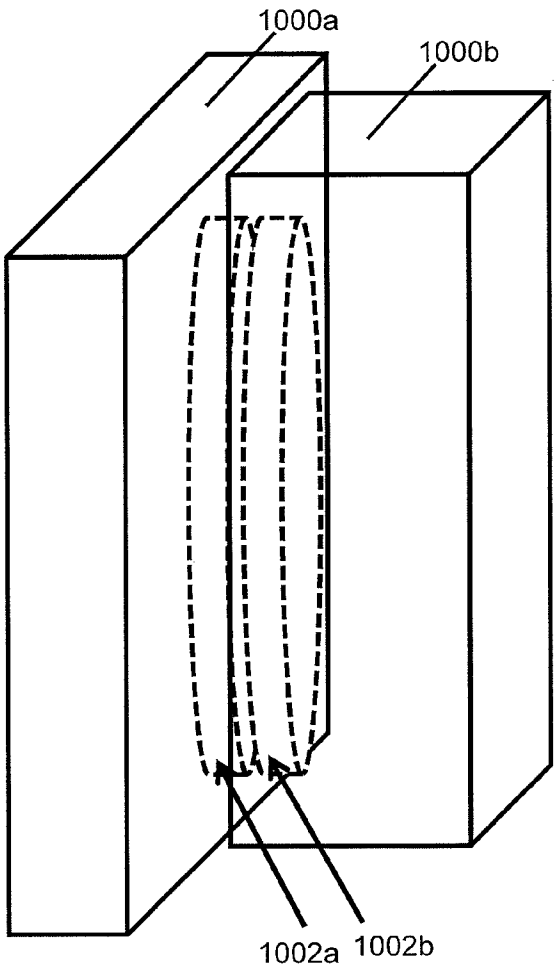
FIGS. 10A and 10B depict first and second objects and complementary magnetic structures associated with the first and second objects.
Figure 10A:
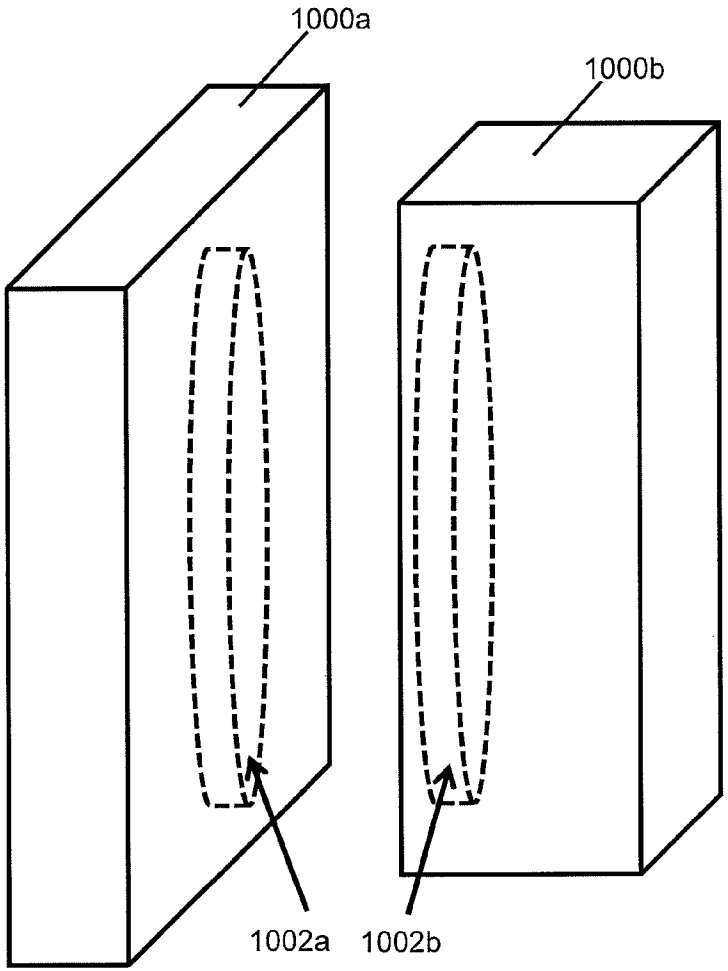

FIGS. 10A and 10B depict exemplary first and second objects 1000*a* 1000*b* and exemplary first and second complementary magnetic structures 1002*a* 1002*b* associated with the first and second objects 1000*a* 1000*b*, where the two objects 1000*a* 1000*b* are separated in FIG. 10A and magnetically attached to each other in FIG. 10B. As shown, the two complementary magnetic structures 1002*a* 1002*b* associated with the two objects 1000*a* 1000*b* are round, but they could be any desired shape as could the two objects 1000*a* 1000*b*. The two magnetic structures 1002*a* 1002*b* may be attached onto outer surfaces of the two objects 1000*a* 1000*b* and/or may be located partially or completely within the two objects 1000*a* 1000*b* (as indicated by the dashed lines). When the two magnetic structures 1002*a* 1002*b* are brought into close proximity and aligned in a specific rotational and translational alignment, the two complementary magnetic structures 1002*a* 1002*b* produce a peak attractive force that causes the two magnetic structures 1002*a* 1002*b* to magnetically attach such that by moving the first object 1000*a* (e.g., turning the object) the magnetically attached second object 1000*b* will be caused to move (e.g., turn) and vice versa. In other words, when magnetically attached, the two objects will move together as if they were one object. The two objects 1000*a* 1000*b* can be magnetically attached without actually touching depending on how they are configured. For example they can be constrained physically such that neither object can touch yet they will move together (e.g., turn about an axis). Additionally, multi-level magnetic field techniques can also be employed to achieve contactless attachment behavior.

If a force greater than the peak attractive force is applied to cause them to pull apart, the two objects will become detached and move independently as separate objects. Moreover, a torque can be applied to one of the objects to misalign and decorrelate the magnetic structures, which can result in the two magnetic structures repelling each other, there being a lesser attractive force between the two magnetic structures, or there being no force between them depending on how the two structures are coded and their relative alignment to each other while decorrelated. The attract force and repel force characteristics of the two magnetic structures correspond to a spatial force function that is in accordance with a code, where the code corresponds to a code modulo of the first magnetic structure and a complementary code modulo of the second magnetic structure. The code defines a peak spatial force corresponding to substantial alignment of the code modulo of the first magnetic structure with the complementary code modulo of the second magnetic structure. The code also defines a plurality of off peak spatial forces corresponding to a plurality of different misalignments of the code modulo of the first magnetic structure and the complementary code modulo of the second magnetic structure. Under one arrangement, the plurality of off peak spatial forces have a largest off peak spatial force, where the largest off peak spatial force is less than half of the peak spatial force.

Figures 11A, 11B, 11C:
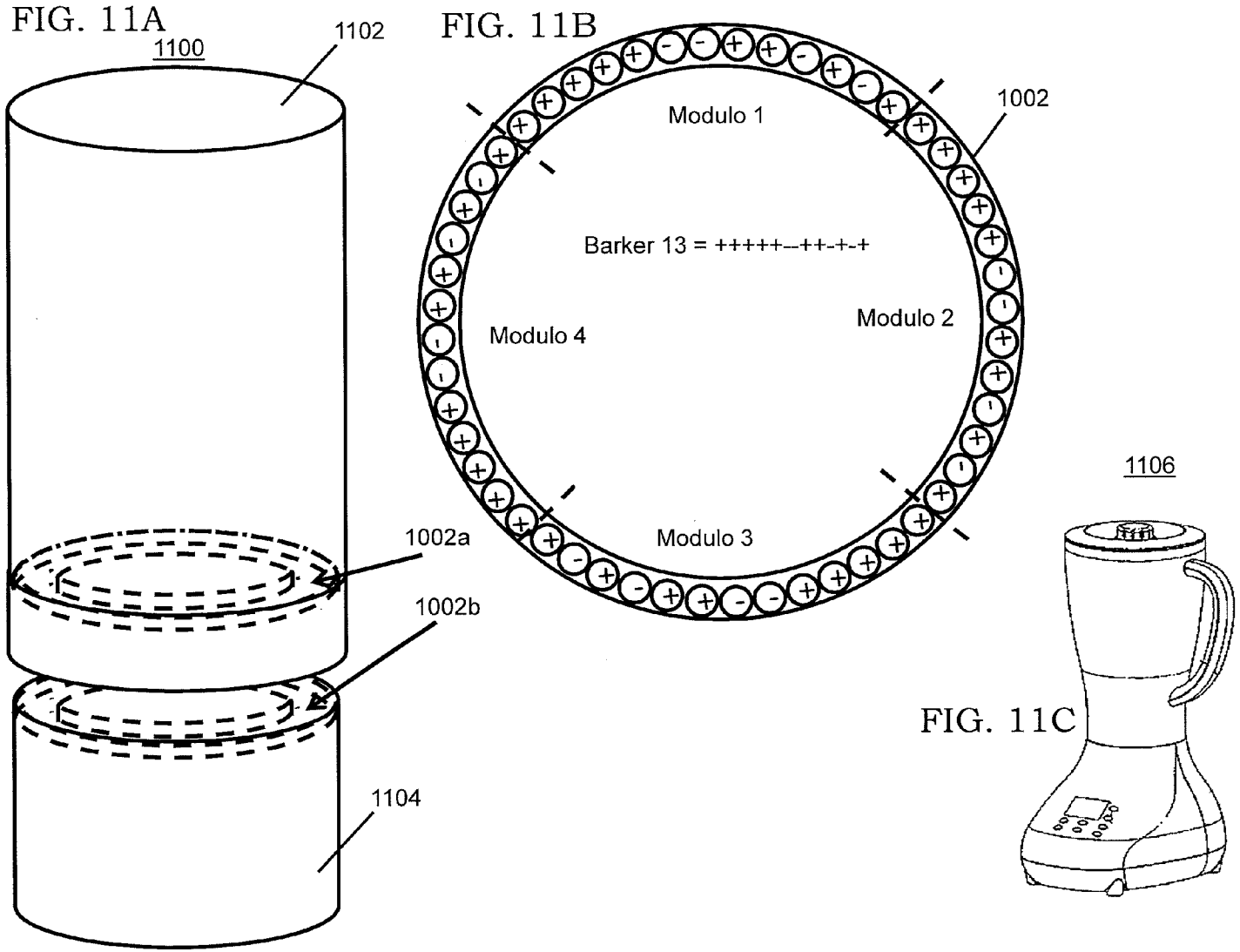
FIG. 11A depicts an exemplary canister assembly comprising a canister and base unit and complementary coded magnetic structures to enable attachment of the canister and the base.
FIG. 11B depicts exemplary coding of a ring magnetic structure that can be used as one of the complementary magnetic structures of FIG. 11A.
FIG. 11C depicts an exemplary blender having a blender jar and blender base.

As described in relation to FIGS. 10A and 10B, two complementary coded magnetic structures 1002*a* 1002*b* can be associated with two objects 1000*a* 1000*b* to enable them to be attached when in proper alignment. FIGS. 11A-11C correspond to an exemplary canister assembly comprising a canister and a base attached with complementary coded ring magnetic structures.

Generally, one skilled in the art of the present invention will understand that it can be applied to various types of appliances such as blenders, food processors, mixers, and the like and also other types of equipment involving rotating blades (or other moving objects) such as lawn mowers, bush hogs, and the like.

FIG. 11A depicts the exemplary canister assembly 1100 comprising a first ring magnetic structure 1002*a* associated with a canister 1102 and a second ring magnetic structure 1002*b* associated with a base unit 1104. The two magnetic structures 1002*a* 1002*b* have complementary coding to enable attachment of the canister 1102 and the base 1104. Each ring magnetic structure could be a ring of multiple discrete magnetic sources arranged in accordance with a code or be a single magnetizable material having had magnetic sources printed onto it in accordance with a code. Alternatively, multiple pieces of magnetizable material having printed magnetic sources could be combined. If multiple code modulos (i.e., instances of a code) are used when coding the structures, multiple alignments between the two objects can achieve the same or similar peak attractive forces. If desired, different types of codes can be employed so that the two objects will have different amounts of attractive force depending on which of some number of desired alignments are used. When multiple magnetic structures are employed, different numbers of magnetic structures can engage or not depending on the orientation of the two objects. One skilled in the art will also recognize that the number, location, and coding of the magnetic structures can be varied to achieve all sorts of different behaviors regarding torque characteristics, pull (tensile) force characteristics, shear force characteristics, and so on, as further described below. For example, the magnetic structures can be coded to produce a peak pull force (peak tensile force) sufficient to enable magnetic attachment and produce a peak shear force sufficient to overcome a predefined amount of applied torque (a torque threshold), whereby producing an amount of torque between the objects greater than the torque threshold will cause the magnetic structures to decorrelate.

Complementary coded ring magnetic structures may have one or more concentric circles of magnetic sources coded in accordance with one or more code modulos of a code. Moreover, portions of ring magnetic structures can be used instead of complete rings. FIG. 11B depicts a ring magnetic structure having one circle of magnetic sources comprising four code modulos of a Barker 13 code (+++++−−++−+−+), where the four code modulos are indicated by the dashed lines. One skilled in the art of the invention would understand that each code modulo of a ring magnetic structure complementary to the ring magnetic structure depicted in FIG. 11B would have magnetic sources having opposite polarities to those shown in FIG. 11B (−−−−−++−−+−+−).

FIG. 11A could correspond to a blender jar that is attached to a blender base unit whereby smooth, easy-to-clean surfaces can be used and there would be a much more easy to use attachment and detachment characteristics than a conventional blender such as depicted in FIG. 11C. As such, the canister (blender jar) 1102 having a coded ring magnetic structure 1002*a* in its bottom portion can be magnetically attached to the base unit (e.g., blender base unit) 1104 having a coded ring magnetic structure 1002*b* in its top portion that is complementary to the coded ring magnetic structure 1002*a* in the bottom of the canister 1102. If the two magnetic structures 1002*a* 1002*b* each have 4 code modulos of complementary Barker 13 codes, the canister 1102 could attach to base 1104 in any one of four positions (i.e., every 90 degrees) and achieve a peak attractive force at any of the four positions yet the canister 1102 can be turned relative to the base 1104 to any other position where it can be removed easily.

Figure 12:
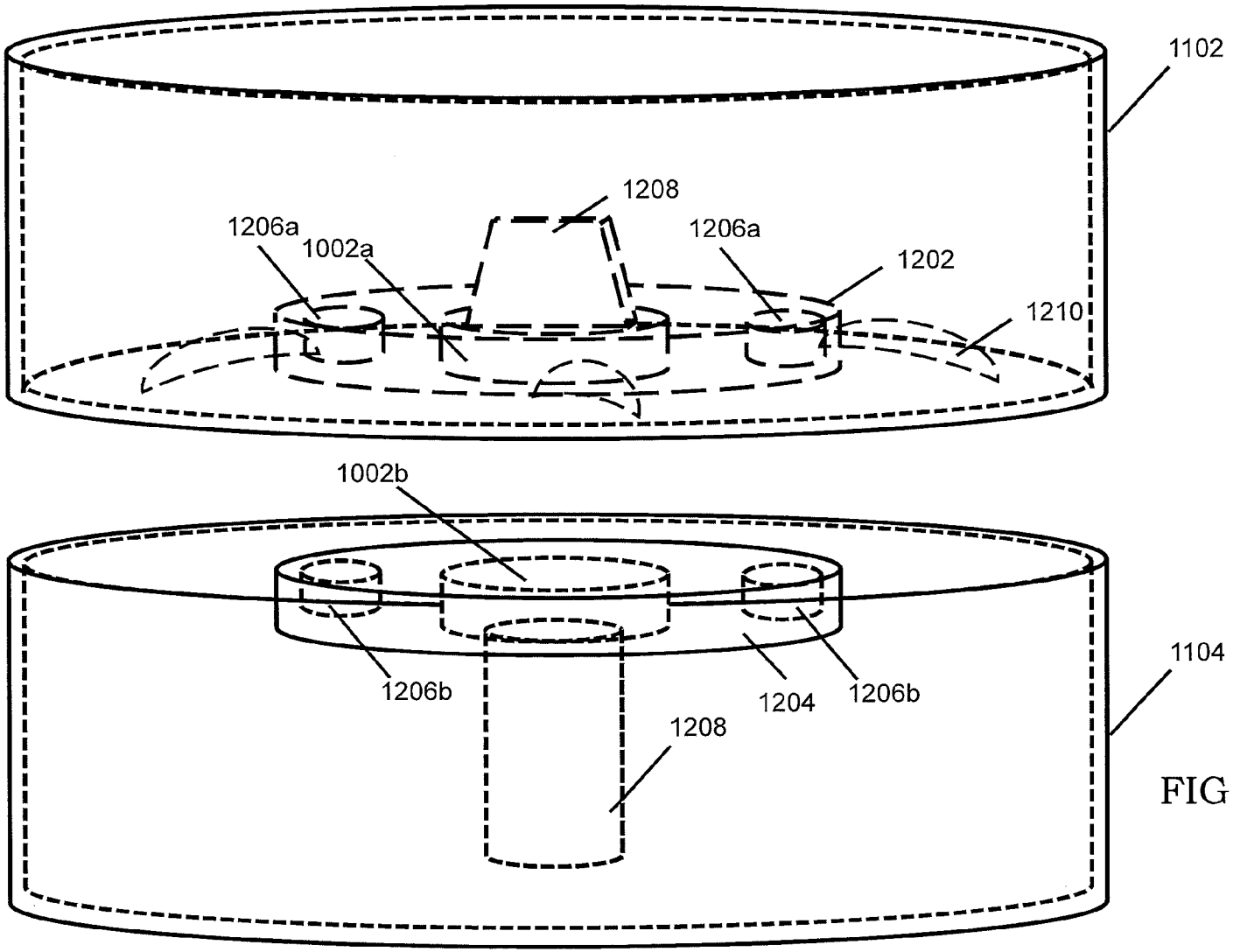
FIG. 12 depicts a blade unit and a motor unit where complementary magnetic structures and secondary magnetic structures enable rapid attachment and detachment while meeting torque requirements.

FIG. 12 depicts a blade unit 1202 and a motor unit 1204 where complementary magnetic structures 1002*a* 1002*b* and secondary magnetic structures 1206*a* 1206*b* enable rapid attachment and detachment while meeting torque requirements. As depicted, the canister 1102 has had a blade unit 1202 placed into its bottom portion that can magnetically attach to a corresponding motor unit 1204 in a base unit 1104 of a blender. A grip handle 1208 enables easy placement of the blade unit 1202 and enables a person to apply torque to remove the blade unit 1202 when desired. The blade unit 1202 includes one or more blades 1210. The blade unit 1202 and motor unit 1204 each have complementary coded magnetic structures 1002*a* 1002*b* that when their complementary magnetic sources are aligned will have strong attachment forces but with a certain applied torque will decorrelate and detach. Additionally, one or more pairs of secondary magnetic structures 1206*a* 1206*b*, which can be coded or non-coded structures, may optionally be used to provide a certain amount of additional attachment (tensile and shear) strength and provide desirable torque characteristics. One skilled in the art will recognize that a torque threshold can be selected above which the blade unit 1202 will detach from the motor unit 1204, which may be desirable to prevent damage during operation.

Figure 13:
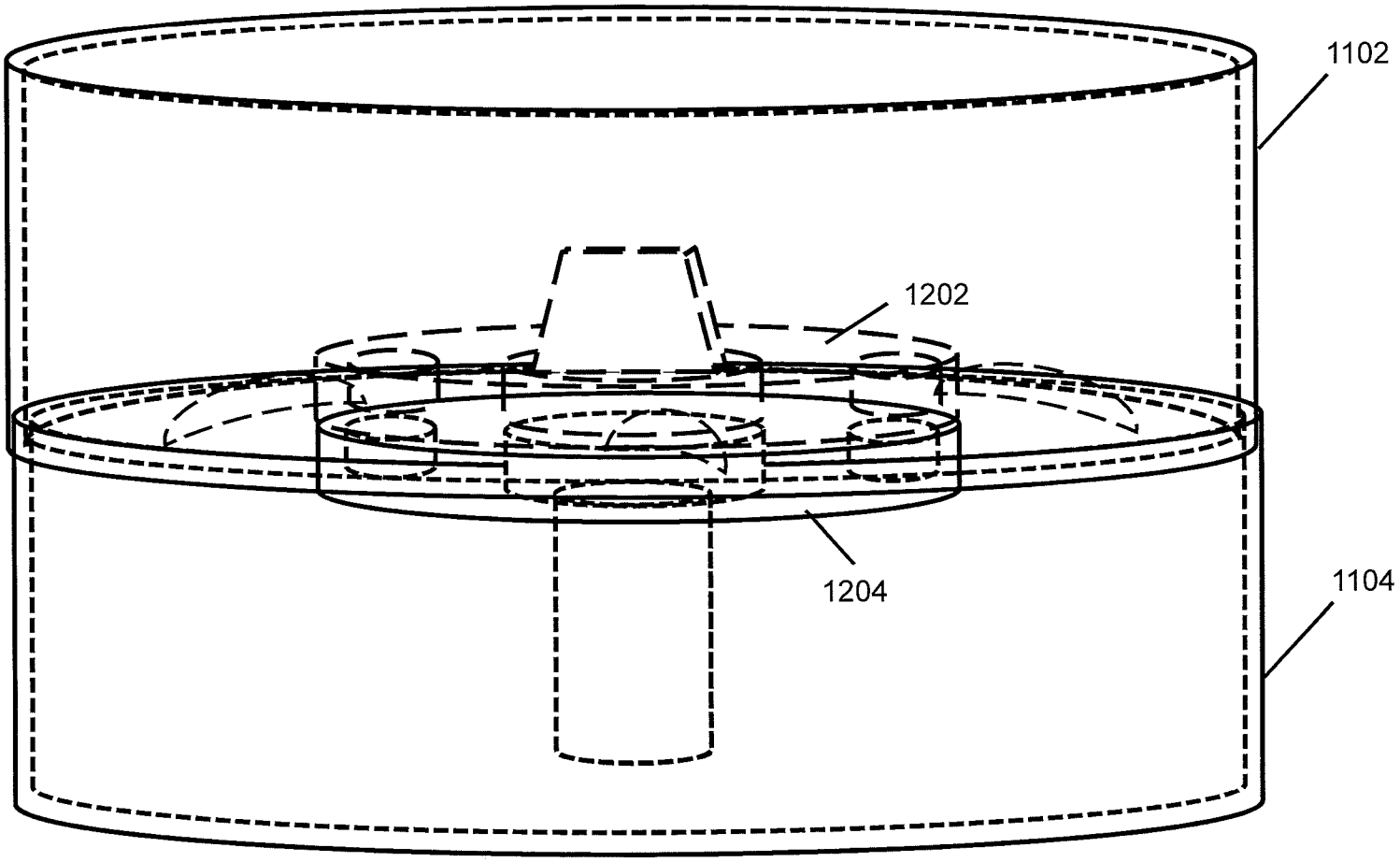
FIG. 13 depicts the blade unit and motor unit of FIG. 12 in an attached position.

FIG. 13 depicts the blade unit 1202 and motor unit 1204 of FIG. 12 in an attached position. The blade unit 1202 and motor unit 1204 as shown are designed to fit in the area within the inside diameter of the two ring magnets of FIG. 11A. Under one arrangement (not shown), the blade unit 1202 has a hole and fits onto a guide located in the center of canister 1102. Under another arrangement (not shown), the blade unit 1202 has a guide that fits into a hole located in the bottom of the canister 1102. Various arrangements are possible for making it easy to install the blade unit 1202 while maintaining a hermetically sealed bottom for easy cleaning. Although, one could practice the invention with different types of objects where such seal characteristics are not required or desirable as might be the case for a blender.

Figure 14:
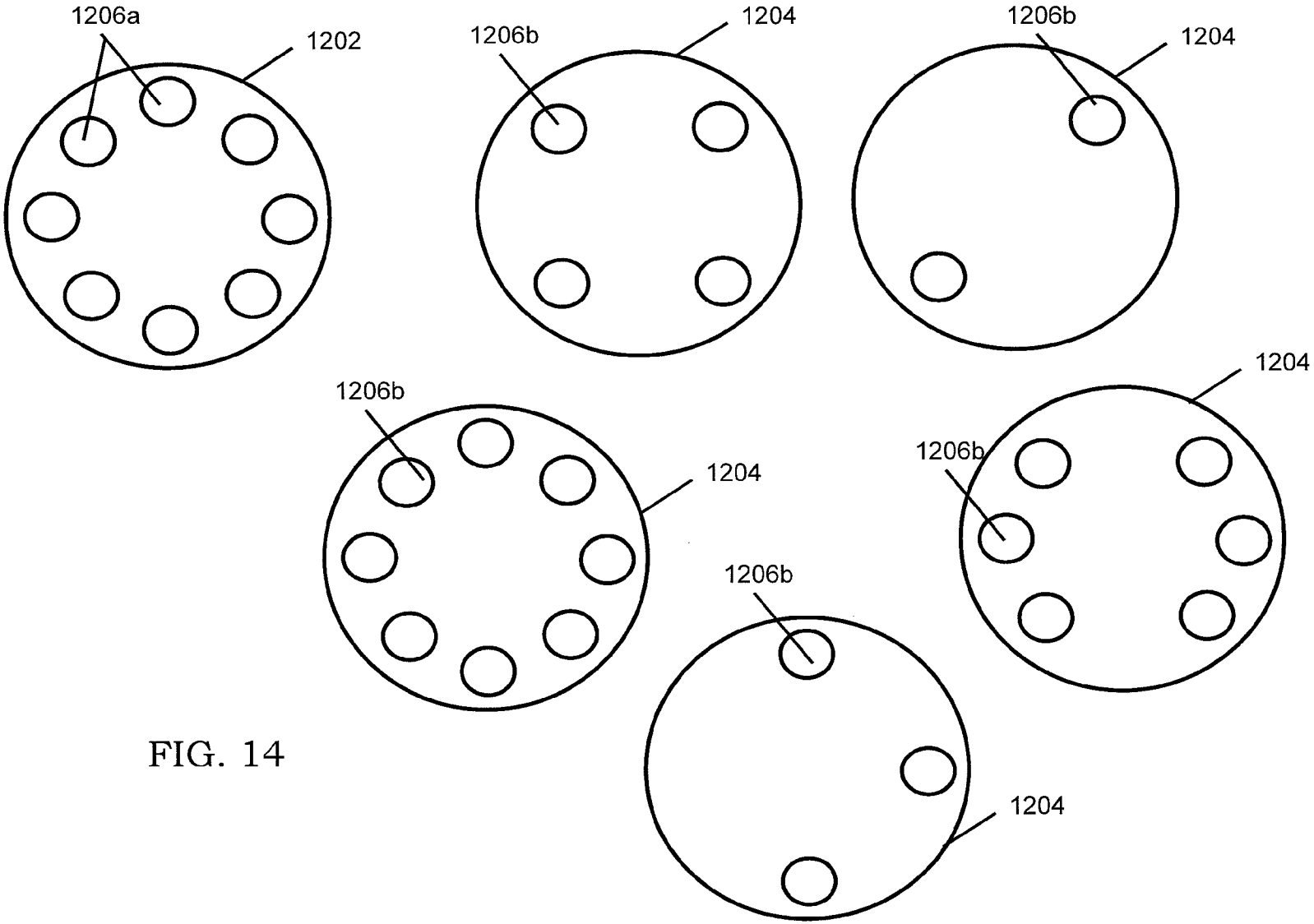
FIG. 14 depicts an attachment portion of a base unit configured with multiple magnetic structures and a variety of blade units configured with different numbers of complementary magnetic structures that will attach to the attachment portion of the base unit.

FIG. 14 depicts an attachment portion of a base unit 1202 configured with multiple magnetic structures 1206*a* and a variety of blade units 1204 configured with different numbers of complementary magnetic structures 1206*b* that will attach to the attachment portion of the base unit. The base unit 1202 and blade units 1204 could have multiple magnetic structures (primary 1002*a* 1002*b* and/or secondary 1206*a* 1206*b*). Different blade units 1204 could have different numbers of magnetic structures 1206*b* thereby causing them to have different "release force" characteristics. One skilled in the art will recognize that all sorts of combinations are possible to enable different attachment strengths, different torque characteristics, and the like. Generally, the lesser number of magnetic structures the less cost of the product. So, certain heavy duty grade blade units 1204 might involve more magnetic structures 1206*b* than blade units 1204 intended for lighter duty.

Figure 15C:
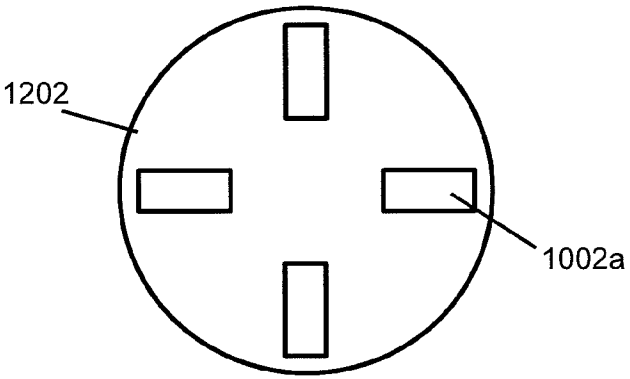
FIG. 15C depicts an attachment portion of a blade unit having fixed magnetic structures.
Figure 15A:
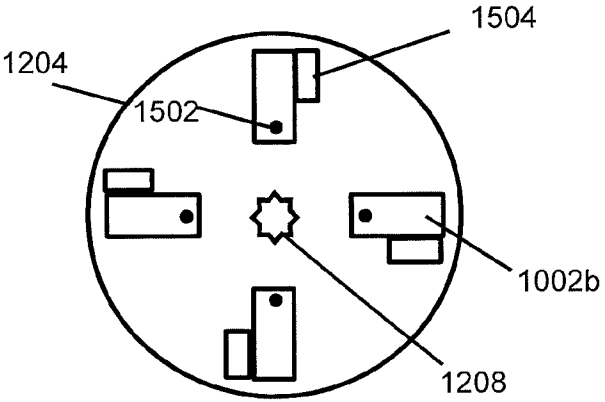
FIGS. 15A and 15B depict an attachment portion of a base unit having multiple magnetic structures configured to pivot over a range of movement controlled by bumpers.
Figure 15B:
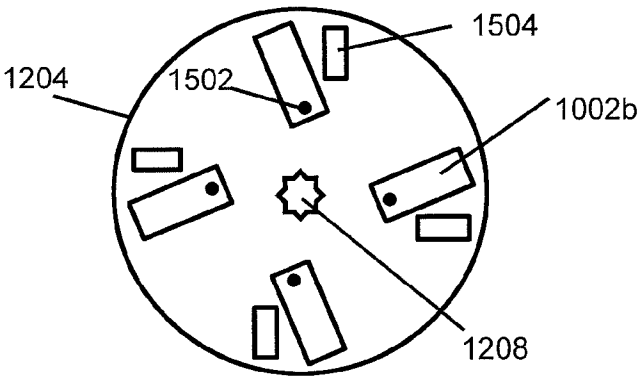

FIGS. 15A and 15B depict an attachment portion of a base unit 1204 having multiple magnetic structures 102*b* configured to rotate about pivot points 1502 over a range of movement controlled by bumpers 1504 and an attachment portion of a blade unit having fixed magnetic structures, where FIG. 15A depicts the magnetic structures 1002*b* in their operational position and FIG. 15B depicts the magnetic structures 1206*b* having been rotated to detachment positions. As depicted, the magnetic structures 1002*b* within a base unit are each able to rotate about pivot points 1502 enabling them to achieve an attachment position and to also rotate to a detach position, where the bumpers restrict movement of the magnetic structures 1002*b* configured to rotate (or pivot) about an axis. In FIG. 15C, corresponding magnetic structures 1002*a* associated with the blade unit 1202 are in fixed locations. As shown in FIG. 12, fixed secondary magnetic structures 1206*a* 1206*b* (coded or non-coded) can also be used to augment the correlated structures 1002*a* 1002*b* so as to achieve desirable characteristics. With this design, turning (rotating) the blade unit 1202 one direction will require overcoming the shear forces between the magnetic structures 102*b* in the base and the magnetic structures 102*a* in the blade unit 1202 since they are prevented from pivoting. Turning the blade unit 1202 in the opposite direction will cause the decorrelation of the complementary magnetic structures 1002*a* 1002*b* thereby enabling detachment.

Figure 16:
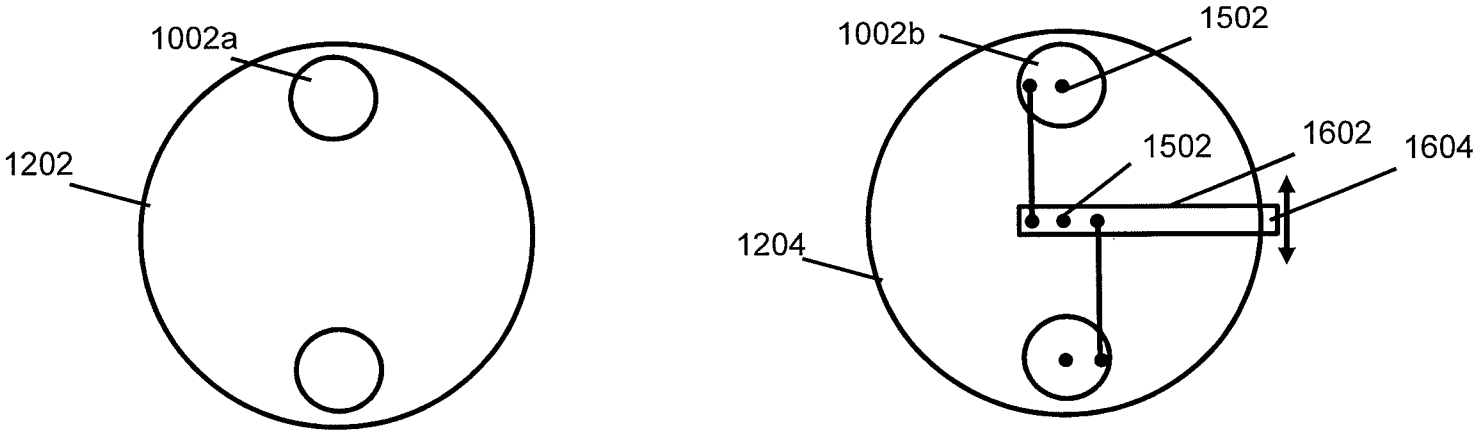
FIG. 16 depicts an attachment portion of a base unit having exemplary mechanical means for causing magnetic structures to turn so as to correlate or decorrelate with magnetic structures in a corresponding blade unit.

FIG. 16 depicts an attachment portion of a base unit 1204 having exemplary mechanical means 1602 for causing magnetic structures 1002*b* to turn so as to correlate or decorrelate with magnetic structures 1002*a* in a corresponding blade unit 1202. By moving a switch 1604 from side to side, the mechanical device 1602 including in the base unit causes the two magnetic structures 1002*b* to rotate from a first correlated position to a second uncorrelated position. One skilled in the art will recognize that all sorts of different types of mechanical devices 1602 could be employed to control correlation and decorrelation of the two structures 1002*a*. Moreover, the examples provided herein could be reversed such that a feature included in the first object (e.g., the canister) could instead be included in the second object (e.g., the base unit).

One skilled in the art will recognize that the blender base unit and blade unit are just examples of where two objects that can be magnetically attached using correlated magnetic structures designed to have specific tensile and shear forces. In particular, such force can be designed into a product to prevent damage when in a bind while also enabling strong attachment and quick and easy detachment. It is also noted that such magnetic structures can be designed so as to achieve desired precision alignment characteristics.

While particular embodiments of the invention have been described, it will be understood, however, that the invention is not limited thereto, since modifications may be made by those skilled in the art, particularly in light of the foregoing teachings.

The invention claimed is:

1. A method for moving an object; comprising:

associating a first magnetic structure with a first object, said first magnetic structure comprising a first plurality of magnetic sources having a first polarity pattern;

associating a second magnetic structure with a second object, said second magnetic structure comprising a second plurality of magnetic sources having a second polarity pattern that is the mirror image of said first polarity pattern, said first object and said second object being constrained such that said first object cannot touch said second object yet said first object and said second object can turn about an axis;

achieving complementary alignment and peak correlation of said first magnetic structure with said second magnetic structure to produce a peak tensile force enabling magnetic attachment of said first object to said second object without said first object touching said second object, said complementary alignment and peak correlation of said first magnetic structure and said second magnetic structure also producing a shear force that prevents misalignment and decorrelation of said first magnetic structure from said second magnetic structure until an amount of torque greater than a torque threshold is applied to said first object, said complementary alignment being when each magnetic source of said first plurality of magnetic sources having a first polarity is aligned with a corresponding magnetic source of said second plurality of magnetic sources having a second polarity that is opposite said first polarity and each magnetic source of said first plurality of magnetic sources having said second polarity is aligned with a corresponding magnetic source of said second plurality of magnetic sources having said first polarity; and moving said second object by moving said first object.

2. The method of claim 1, wherein said first polarity pattern and said second polarity pattern are in an accordance with a code, wherein the code corresponds to a code modulo of the first magnetic structure and a complementary code modulo of the second magnetic structure, the code defines a peak spatial force corresponding to substantial alignment of the code modulo of the first magnetic structure with the complementary code modulo of the second magnetic structure, the code also defines a plurality of off peak spatial forces corresponding to a plurality of different misalignments of the code modulo of the first magnetic structure and the complementary code modulo of the second magnetic structure, the plurality of off peak spatial forces having a largest off peak spatial force, and the largest off peak spatial force is less than half of the peak spatial force.

3. The method of claim 1, further comprising:

associating a first secondary magnetic structure with said first object; and associating a second secondary magnetic structure with said second object, said first and second secondary magnetic structures providing additional shear force between said first and second object.

4. The method of claim 3, wherein at least one of said first secondary magnetic structure or said second secondary magnetic structure is configured to rotate about a pivot point.

5. The method of claim 4, wherein a range or rotation of said first secondary magnetic structure or said second secondary magnetic structure is limited.

6. The method of claim 1, wherein said first object comprises a motor.

7. The method of claim 1, wherein said second object comprises a blade.

8. The method of claim 1, wherein said first object and said second object correspond to one of a blender, food processor, mixer, lawnmower, or bush hog.

9. The method of claim 1, wherein rotating said first object rotates said second object.

10. The method of claim 1, where said first magnetic structure and said second magnetic structure are ring magnetic structures.

11. A system for moving an object; comprising:

a first magnetic structure associated with a first object, said first magnetic structure comprising a first plurality of magnetic sources having a first polarity pattern;

a second magnetic structure associated with a second object, said second magnetic structure comprising a second plurality of magnetic sources having a second polarity pattern that is the mirror image of said first polarity pattern, said first object and said second object being constrained such that said first object cannot touch said second object yet said first object and said second object can turn about an axis;

said first magnetic structure with said second magnetic structure being in a complementary alignment resulting in a peak correlation and producing a peak tensile force enabling magnetic attachment of said first object to said second object without said first object touching said second object, said complementary alignment also producing a shear force that prevents misalignment and decorrelation of said first magnetic structure from said second magnetic structure until an amount of torque greater than a torque threshold is applied to said first object, said complementary alignment being when each magnetic source of said first plurality of magnetic sources having a first polarity is aligned with a corresponding magnetic source of said second plurality of magnetic sources having a second polarity that is opposite said first polarity and each magnetic source of said first plurality of magnetic sources having said second polarity is aligned with a corresponding magnetic source of said second plurality of magnetic sources having said first polarity.

12. The system of claim 11, wherein said first polarity pattern and said second polarity pattern are in an accordance with a code, wherein the code corresponds to a code modulo of the first magnetic structure and a complementary code modulo of the second magnetic structure, the code defines a peak spatial force corresponding to substantial alignment of the code modulo of the first magnetic structure with the complementary code modulo of the second magnetic structure, the code also defines a plurality of off peak spatial forces corresponding to a plurality of different misalignments of the code modulo of the first magnetic structure and the complementary code modulo of the second magnetic structure, the plurality of off peak spatial forces having a largest off peak spatial force, and the largest off peak spatial force is less than half of the peak spatial force.

13. The system of claim 11, further comprising:

a first secondary magnetic structure associated with said first object; and a second secondary magnetic structure associated with said second object, said first and second secondary magnetic structures providing additional shear force between said first and second object.

14. The system of claim 13, wherein at least one of said first secondary magnetic structure or said second secondary magnetic structure is configured to rotate about a pivot point.

15. The system of claim 14, wherein a range or rotation of said first secondary magnetic structure or said second secondary magnetic structure is limited.

16. The system of claim 11, wherein said first object comprises a motor.

17. The system of claim 11, wherein said second object comprises a blade.

18. The system of claim 11, wherein said first object and said second object correspond to one of a blender, food processor, mixer, lawnmower, or bush hog.

19. The system of claim 11, wherein rotating said first object rotates said second object.

20. The system of claim 11, where said first magnetic structure and said second magnetic structure are ring magnetic structures.

* * * * *